United States Patent [19]

Bastenhof

[11] Patent Number: 4,705,006

[45] Date of Patent: Nov. 10, 1987

[54] FUEL INJECTION PUMP FOR AN INTERNAL COMBUSTION ENGINE COMPRISING A DEVICE FOR ADJUSTING THE INSTANT OF INJECTION FUEL DELIVERY

[76] Inventor: Dirk Bastenhof, 25, rue Tarbé des Sablons, 95600 Eaubonne, France

[21] Appl. No.: 367,980

[22] Filed: Apr. 13, 1982

[30] Foreign Application Priority Data

Apr. 16, 1981 [FR] France ..... 81 07685

[51] Int. Cl.[4] ..... F02M 39/00

[52] U.S. Cl. ..... 123/506; 123/458; 123/501; 417/307; 417/304

[58] Field of Search ..... 123/500, 501, 502, 506, 123/503, 458, 357; 417/283, 288, 289, 304, 307; 239/88-96

[56] References Cited

U.S. PATENT DOCUMENTS

| | | | |
|---|---|---|---|
| 4,343,280 | 8/1982 | Luscomb | 123/458 |
| 4,364,351 | 12/1982 | Romblom | 123/357 |
| 4,385,614 | 5/1983 | Eheim | 123/506 |

FOREIGN PATENT DOCUMENTS

| | | | |
|---|---|---|---|
| 0020249 | 12/1980 | European Pat. Off. . | |
| 1917927 | 10/1970 | Fed. Rep. of Germany . | |
| 2018112 | 12/1970 | Fed. Rep. of Germany . | |
| 693493 | 11/1930 | France . | |
| 2095695 | 2/1972 | France . | |
| 2404118 | 4/1979 | France . | |
| 275601 | 6/1930 | Italy | 123/506 |
| 160503 | 12/1953 | Sweden | 123/506 |
| 2041577 | 9/1980 | United Kingdom . | |

*Primary Examiner*—Charles J. Myhre
*Assistant Examiner*—Carl Stuart Miller

[57] ABSTRACT

Internal combustion engine fuel injection pump of the type comprising an injection piston having a head with a helical ramp and provided with a device for adjusting in time the beginning of the fuel injection delivery. The adjusting device comprises a valve for closing and opening a bypass passage adapted to connect the said admission chamber to a space communicating with the chamber filling fuel source, and a system for the control of the valve including a control device for closing the valve depending on the angular position of a rotary member of the engine, such as a crankshaft, and for opening the valve in response to a partial vacuum created in the admission chamber by the suction stroke of the injection piston.

8 Claims, 1 Drawing Figure

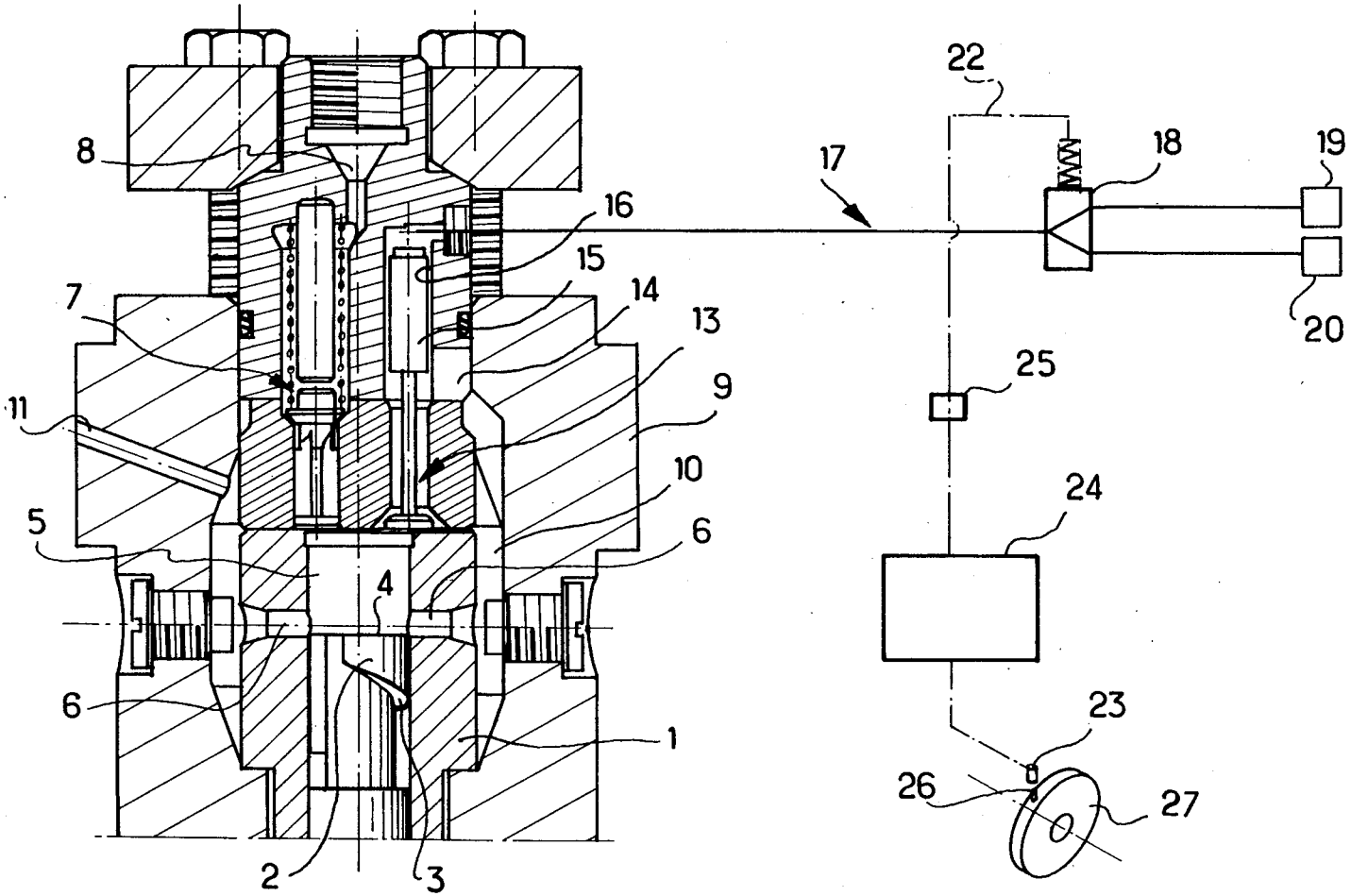
19
20
18
22
17
25
24
23
27
26
16
15
14
13
9
10
6
1
3
4
2
8
7
11
5
6

FUEL INJECTION PUMP FOR AN INTERNAL COMBUSTION ENGINE COMPRISING A DEVICE FOR ADJUSTING THE INSTANT OF INJECTION FUEL DELIVERY

The present invention has for a subject matter a fuel injection pump for an internal combustion engine, the pump being provided with a device for adjusting the instant of delivery of fuel from the pump towards the injector. The invention relates more particularly to an injection pump including a chamber for the admission of fuel through fuel admission ports, the volume of the chamber being variable by means of a piston of the type including a head with a helical edge and displaceable in the said chamber in a rectilinear to-and-fro movement between a lower dead centre position and an upper dead centre position and adapted to cover the said admission ports at the beginning of each stroke towards its upper dead centre position.

There are already known injection pumps of this type, which are equipped with a device allowing the adjustment of the instant of injection fuel delivery. These devices comprise essentially a chamber for the accumulation of a predetermined amount of fuel discharged by the piston after the covering of the admission ports. A piston is slidingly mounted in this chamber and moves backward as the delivery piston moves forward, so as to prevent the building-up in this chamber of a pressure sufficient to open the pump outlet valve. This opening takes place when the piston of the accumulator reaches its endmost position. For the instant of delivery of the fuel towards the injector to be adjustable, the endmost position of the piston must be variable.

This adjusting device is complex and occupies much space. Its complexity is all the more considerable as the adjustment must be made depending on certain parameters of the engine.

The purpose of the present invention is to ensure an adjustment of the instant of delivery of the fuel from the pump, which is very simple and occupies little space, even if the adjustment must be effected depending on various parameters of the engine.

The injection pump according to the invention comprises to this end an adjusting device including a valve for closing and opening a bypass passage connecting the admission chamber to a space communicating with the source of fuel for filling the admission chamber, and a system for the control of this valve, the control system comprising a control device for closing the valve depending on the angular position of a rotary member of the engine, such as the crankshaft.

According to an advantageous characterizing feature of the invention, the valve control system is so arranged that the opening of the valve is determined by the partial vacuum in the admission chamber produced during the movement of the piston towards its lower dead centre position after the end of the injection fuel delivery.

According to another advantageous characterizing feature, the valve control system comprises a hydraulic control circuit provided with an electro-valve whose electric circuit includes a transducer sensitive to the angular positions of the rotary member of the engine and, if appropriate, a delay element whose retarding action depends on an operating parameter of the engine, mounted in the circuit of the signal produced by the transducer.

The invention will be better understood and other purposes, characterizing features, details and advantages of the latter will appear more clearly from the following explanatory description made with reference to the appended diagrammatic drawing given solely by way of example illustrating one form of embodiment of the invention and wherein:

the single FIGURE is an axial sectional view of the injection pump according to the invention, with a diagrammatic representation of the system of control of the adjusting device.

The injection pump represented in the FIGURE comprises essentially a cylindrical hollow body 1 in which is mounted an axially slidable piston 2 provided with a head of the type with a helical edge 3. The piston 2 is displaceable within the body 1 in a rectilinear to-and-fro movement between a lower dead centre position and an upper dead centre position. The body 1 defines above the delivery surface 4 of the piston 2 a fuel admission chamber 5. This chamber is filled with fuel through ports 6 traversing the cylindrical walls of the body 1 in proximity to the lower dead centre of the piston 2 so as to be coverable by the latter at the beginning of its up-stroke. The reference numeral 7 denotes generally a delivery member intended to open or close a passage 8 for the delivery of fuel from the admission chamber 5 and therefore from the injection pump, towards the injector. It is also seen that a casing 9 surrounds the injection pump portion just described, thus providing an internal annular space 10 into which open the admission ports 6. The space 10 communicates with the exterior through a passage 11 which ensures its feeding with fuel.

The device for adjusting the instant of delivery of fuel towards the injector through the outlet passage 8 is essentially constituted by a valve 13 for opening and closing a bypass passage 14 connecting the chamber 5 to the space 10. The valve 13 is provided with a control plunger 15 mounted slidingly and in a fluid-tight manner in a cylindrical bore 16 provided in the upper portion of the pump. The portion of the bore 16 that is located above the plunger 15 communicates with a hydraulic control circuit 17 which comprises an electro-valve 18 for alternately connecting the upper portion of the bore 16 to a source 19 of hydraulic fluid at weak pressure and a source 20 of hydraulic fluid at relatively high pressure.

The electric circuit 21 for the control of the electro-valve 18 comprises essentially the following, mounted in series: a transducer 23, a delay device 24 and an over-speed switch 25. The transducer 23 co-operates with a member 26 forming part of a rotary flywheel 27 associated with the crankshaft (not shown). The delay device 24 is designed to retard the electric signals produced by the transducer 23 depending on one or more parameters of the engine, such as the intake air pressure to the engine, the position of the rack of the fuel pumps, the maximum pressure of the combustion cycle or the engine speed.

By way of example, the weak-pressure source 19 may supply a fluid at a pressure from 1 to 5 bars. The pressure of the fluid proceeding from the source 20 of relatively high pressure may be of the order of 20 bars. There will now be described the operation of the injection pump just described and more particularly that of the device for adjusting the instant of fuel delivery towards the injector.

In moving towards its upper dead centre position, the piston 2 covers the admission ports 6 and continues its upward stroke. During this first period of the up-stroke of the piston 2, the electro-valve 18 is in such a position that the fluid proceeding from the source 20 of relatively high pressure acts on the plunger 15 of the valve 13. The latter therefore is maintained open. This means that the admission chamber 5 of the pump communicates with the space 10 through the bypass passage 14. The fuel delivered by the piston 2 therefore flows into the chamber 10. The pressure in the chamber 5 remains at a relatively low value insufficient to open the delivery member 7 located in the outlet passage 8 leading to the injector.

At a given instant determined by the passing of the member 26 of the flywheel 27 in front of the transducer 23, an electric signal is supplied to the electro-valve 18 and changes its position. The valve plunger 15 is no longer exposed to the fluid at strong pressure proceeding from the source 20 and is only subjected to the fluid at weak pressure from the source 19. The pressure drop above the plunger 15 results in the closing of the valve 13. Since the piston 2 continues its stroke towards its upper dead centre position, the pressure within the chamber 5 increases and causes the opening of the delivery member 7. This means that the fuel delivery towards the injector is beginning. The delivery ends when the helical edge 3 passes an admission port 6.

The valve 13 again opens during the down-stroke of the delivery piston 2 towards its lower dead centre position, when the ports 6 are again covered, under the action of the partial vacuum thus produced in the chamber 5. This opening of the valve 13 during the down-stroke of the delivery piston 2 contributes to a good filling of the chamber 5 between fuel deliveries. The strong pressure above the plunger 15 of the valve 13 is thereafter smoothly restored to again lock the valve 13 in its open position.

The instant of supply of the control signal by the transducer 23 to the electro-valve 18 may be chosen relatively close to the instant of beginning of delivery determined by the cooperation between the piston 2 and the admission ports 6. In order that the instant of beginning of delivery may be varied within a relatively large range after the closing of the valve 13, it is sufficient to introduce, through the medium of the delay device 24, a delay between the instant of supply of the signal by the transducer 23 and the instant of pressure drop above the plunger of the valve 13. This delay may be chosen depending on the engine speed, on the intake air pressure to the engine, on the position of the injection pump rack, on the maximum pressure of the combustion cycle or on any other engine parameter.

The device according to the invention may also operate in case of overspeed by opening overspeed switch 25. This prevents the pressure above the valve plunger 15 from dropping.

In the case of failure of the adjusting system according to the invention, the system may be put out of service by disconnecting the hydraulic circuit from the source 20 of relatively high pressure. The instant of fuel delivery towards the injector is then determined by the co-operation of the delivery piston 2 with the intake ports 6, i.e. the engine operates with an obviously greater advance which is determined mechanically. In this case, a quick mechanical adjustment allows continued operation of the engine, although without the variable injection advance provided by the above described control system.

It appears from the description of the invention just made that the arrangements which are specific to the invention allow adjusting the instant of injection or, in other words, the injection advance, within a considerable range of values by means of a simple and compact structure. Moreover, the end of the injection delivery is advantageously determined by the passing of the helical edge 3 in front of the admission ports 6 and not by the opening of the valve 13. On the contrary, the valve 13, in order to open, does not need to overcome a high pressure.

An important characterizing feature of the invention is that the movable parts move only in the presence of weak pressures, which is particularly important as regards reliability.

It is useful to bear in mind that the purpose of the adjustment of the delivery instant lies mainly in the optimization of the engine operating conditions with a view to reducing the specific consumption by adjusting the maximum pressure of the cycle through an adjustment of the injection instant.

It should be noted that many modifications may be introduced in the device described and illustrated, without departing from the scope of the invention. Use may be made, instead of the electro-valve, of any other appropriate element comprising several passages, or of a piezo-electric valve.

It should also be noted that the control piston 15 need not necessarily be mounted in a fluid-tight manner in the cylindrical bore 16. Fluid-tightness is not necessary in case of fuel oil in the hydraulic system 17, 19, 20. Even in case of use of oil in the hydraulic system, a slight leakage may be tolerated. One may contemplate excluding the hydraulic control circuit and controlling the valve directly by an electric signal, e.g. by means of a solenoid.

More generally, the invention is by no means limited to the form of embodiment described and illustrated which has been given by way of example only. In particular, it comprises all means constituting technical equivalents to the means described, as well as their combinations, should the latter be carried out according to its gist and used within the scope of protection claimed.

What is claimed is:

1. A fuel injection pump for an internal combustion engine, the pump including a cylinder having a fuel admission chamber, a piston reciprocally disposed in the admission chamber for movement in one direction from a first position to a second position to decrease the volume of the chamber in an injection stroke and in an opposite direction from the second position to the first position to increase the volume of the chamber in a suction stroke, the piston having a head with a helical edge, a source of fuel outside the cylinder, admission ports located near the second position of the piston and connecting the source of fuel to the admission chamber, an injector means for delivering fuel from the admission chamber to the injector when the pressure in the admission chamber exceeds a predetermined value, and apparatus for adjusting the initiation of fuel delivery from the admission chamber to the injector, said apparatus including a bypass passage connecting the admission chamber to the source of fuel, a bypass valve in the bypass passage, and a control system for controlling the valve to shut the bypass passage in response to a closing control signal, wherein the improvement comprises the bypass valve being shut by a flow of fuel leaving the admission chamber during the injection stroke of the injection piston under receipt by the control system of said closing control signal, and the bypass valve being opened by a partial vacuum developed in the admission chamber during the suction stroke of the injection piston.

2. A fuel injection pump according to claim 1, wherein the control system comprises a hydraulic circuit including a first source of fluid at relatively high pressure, a second source of fluid at relatively low pressure, a working chamber located adjacent to the bypass passage, a control plunger connected to said valve and movably disposed in the working chamber, and a three-way pilot valve connected between the first and second fluid sources and the working chamber, said pilot valve being responsive to said closing control signal to transfer the working chamber from communication with the first fluid source to communication with the second fluid source.

3. A fuel injection pump according to claim 2, wherein said control plunger is integrally formed and coaxial with the bypass valve.

4. A fuel injection pump according to claim 2, wherein the pressure of the first fluid source, when acting on the control plunger in the working chamber, is sufficiently high to maintain the bypass valve in the open condition when the bypass valve is exposed to said flow of fuel leaving the admission chamber during the injection stroke of the piston.

5. A fuel injection pump according to claim 2, wherein the pressure of the second fluid source, when acting on the control plunger in the working chamber, is insufficient to maintain the bypass valve in the open condition when the bypass valve is exposed to said flow of fuel leaving the admission chamber during the injection stroke of the piston but is high enough to open the bypass valve when the bypass valve is exposed to said partial vacuum during the suction stroke of the piston.

6. A fuel injection pump according to claim 2, wherein said control system further comprises means for applying said closing control signal in response to an angular position of a rotary member driven in synchronism with the rotation of the engine, said means including a transducer sensitive to predetermined angular positions of said rotary member and coupled to said three-way pilot valve.

7. A fuel injection pump according to claim 6 wherein the transducer is sensitive to a first angular position of the rotary member for initiating a closing control signal during each injection stroke of the piston and for terminating said closing control signal during the next following suction stroke of the piston.

8. A fuel injection pump according to claim 5, wherein said control system further comprises a delay device connected between the transducer and the three-way pilot valve for retarding a signal produced by said transducer in response to at least one operating parameter of the engine.

* * * * *